US005581218A

United States Patent [19]

Bagalini et al.

[11] Patent Number: 5,581,218

[45] Date of Patent: Dec. 3, 1996

[54] CIRCUIT BREAKER

[75] Inventors: Dante Bagalini, Johannesburg; Alan G. Sugden, Kempton Park; Danny Hadary, Johannesburg, all of South Africa

[73] Assignee: Circuit Breaker Industries Ltd., Elandsfontein, South Africa

[21] Appl. No.: 316,098

[22] Filed: Sep. 30, 1994

[30] Foreign Application Priority Data

Oct. 27, 1993 [ZA] South Africa ..... 93/8008

[51] Int. Cl.[6] ..... H01H 73/12

[52] U.S. Cl. ..... 335/17; 335/202; 340/638

[58] Field of Search ..... 335/17, 202; 340/638, 340/639; 200/308–9, 305, 317, 312

[56] References Cited

U.S. PATENT DOCUMENTS

| | | | |
|---|---|---|---|
| 4,068,283 | 1/1978 | Russell . | |
| 4,860,157 | 8/1989 | Russell . | |
| 5,075,659 | 12/1991 | Morgan et al. | 335/17 |
| 5,140,115 | 8/1992 | Morris | 335/17 |

*Primary Examiner*—Lincoln Donovan
*Attorney, Agent, or Firm*—Ladas & Parry

[57] ABSTRACT

A circuit breaker 10 includes a housing and an operating mechanism 12 contained within the housing. An indicating arrangement is carried by the operating mechanism 12 and is displaceable relative to the housing under the action of the operating mechanism 12 for indicating the status of the operating mechanism 12.

8 Claims, 4 Drawing Sheets

CIRCUIT BREAKER

BACKGROUND OF THE INVENTION

This invention relates to a circuit breaker.

SUMMARY OF THE INVENTION

According to the invention, there is provided a circuit breaker which includes a housing;

an operating mechanism contained within the housing; and an indicating means carried by the operating mechanism and being displaceable relative to the housing under the action of the operating mechanism for indicating the status of the operating mechanism.

The housing may include a wall having a window defined therein, the indicating means being arranged within the housing and being visible through the window.

The circuit breaker may be of the type having earth leakage protection capabilities. Thus, the operating mechanism may include an earth leakage trip facility and the indicating means may then be capable of distinguishing between tripping as a result of an overload fault or as a result of an earth leakage fault.

The operating mechanism may include a handle, the handle being displaceable between an "on" position, an "off" position and a tripped position. A first part of the indicating means may then comprise a slider mounted on the handle to be displaceable therewith and relative to the window of the housing.

The slider may carry indicia thereon for indicating whether the operating mechanism is in its on condition or off condition, the appropriate indicia being visible through the window of the housing depending on the condition of the operating mechanism. Typically, the indicia may comprise a first label carrying the word "ON" and a second label carrying the word "OFF".

The indicating means may further include a first indicating element carried by the operating mechanism, the first indicating element being visible through the window when the operating mechanism has tripped due to an overload fault condition.

In the event of an overload trip, a trip lever of the operating mechanism, displaced by an overload relay of said operating mechanism, may release a catch on a cradle of the operating mechanism to cause the cradle to move to its tripped position.

Thus, the first indicating element may be a first flag carried on the cradle of the operating mechanism which is visible through the window when the cradle is in its tripped position.

The indicating means may also include a second indicating element carried by the operating mechanism, the second indicating element being visible through the window when the operating mechanism has tripped due to an earth leakage fault condition.

The second indicating element may be a second flag carried by a reset lever of the operating mechanism.

When the trip lever is displaced by a shunt trip armature of the operating mechanism of the circuit breaker, as a result of an earth leakage fault, the cradle, with its first flag, is rotated so that the first flag is in register with the window in the housing. However, the second flag carried on the reset lever of the operating mechanism, on the occurrence of an earth leakage fault, is placed in register with the window, between the window and the first flag. Then, the second flag is visible through the window in the housing.

It will be appreciated that the first flag is distinguishable from the second flag to ascertain readily what type of fault caused tripping of the circuit breaker.

The slider may have an opening defined therein, which when the handle of the operating mechanism is in its tripped position, lies in register with the window of the housing. The first label of the slider may be arranged below the opening to be visible through the window when the circuit breaker is on. Conversely, the second label may be arranged above the opening to be visible in the window when the circuit breaker is off.

It will be appreciated that an appropriate one of the flags is visible through the opening and the window when the operating mechanism is in its tripped condition.

Further, the arrangement of the slider on the handle is such that, even if the operating mechanism trips but, due to welding of the contacts, the contacts remain in contact, the "ON" label will be visible through the window in the housing to provide an indication that the circuit breaker is still in a dangerous condition.

The invention is now described by way of example with reference to the accompanying diagrammatic drawings.

DETAILED DESCRIPTION OF THE DRAWINGS

Figure 1:
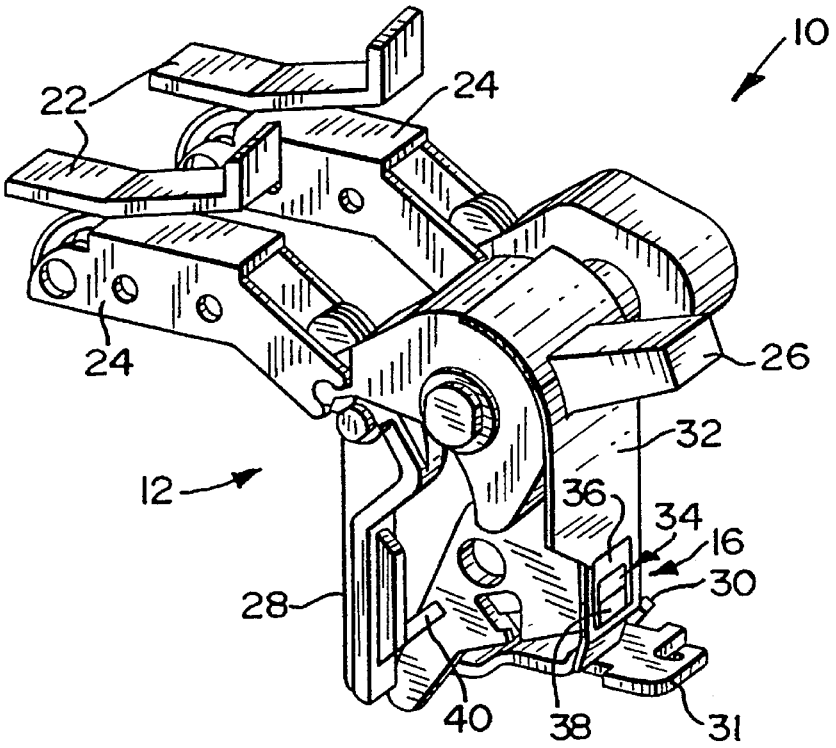
FIG. 1 shows a three dimensional view of part of a circuit breaker, in accordance with the invention, with an operating mechanism thereof in its on configuration.

Referring to the drawings, a circuit breaker, in accordance with the invention, is illustrated and is designated generally by the reference numeral 10. The circuit breaker 10 comprises an operating mechanism 12 and a housing, part of which is illustrated at 14 in FIGS. 6 and 7 of the drawings.

An indicating means 16 is carried by the operating mechanism 12 for indicating the status of the operating mechanism 12.

A viewing aperture in the form of a window 18 is defined in a wall 20 of the housing 14.

The operating mechanism 12 includes a pair of fixed contacts 22, each contact 22 having a moving contact 24 associated therewith. The moving contacts 24 are movable into and out of engagement with the fixed contacts 22 by means of an operating handle 26.

The operating mechanism 12 further includes, in a conventional manner, a cradle 28 which is released on an overload trip under the action of a trip lever which is displaced by an overload relay (neither of which is shown). Upon release of the cradle 28 it pivots from the position shown in FIGS. 1 and 5 of the drawings to a position shown in FIGS. 2 to 4 of the drawings.

The operating mechanism 12 also includes an earth leakage facility having a reset lever 30. The earth leakage facility includes a shunt trip armature 31 which, on the occurrence of an earth leakage fault, acts on the cradle 28 to cause rotation of the cradle 28, as will be described in greater detail below.

The indicating means 16 includes a slider 32 mounted on the handle 26. The slider 32 has an opening 34 defined therein, the opening 34 being shown in greater detail in FIGS. 6 and 7 of the drawings.

Above the opening 34 a green label 36 with the inscription "OFF" is affixed to the slider 32. Below the window 34, a red label 38 with the inscription "ON" is affixed to the slider 32.

The cradle 28 carries a flag 40 thereon which, when the cradle 28 is in its tripped position, is visible through the opening 34 in the slider 32.

The reset lever 30 of the earth leakage facility of the operating mechanism 12 also carries a flag 42 (FIG. 7) thereon. When the reset lever 30 of the earth leakage facility is in its tripped position, the flag 42 is visible through the opening 34 in the slider 32, as will be described in greater detail below.

Figure 6:
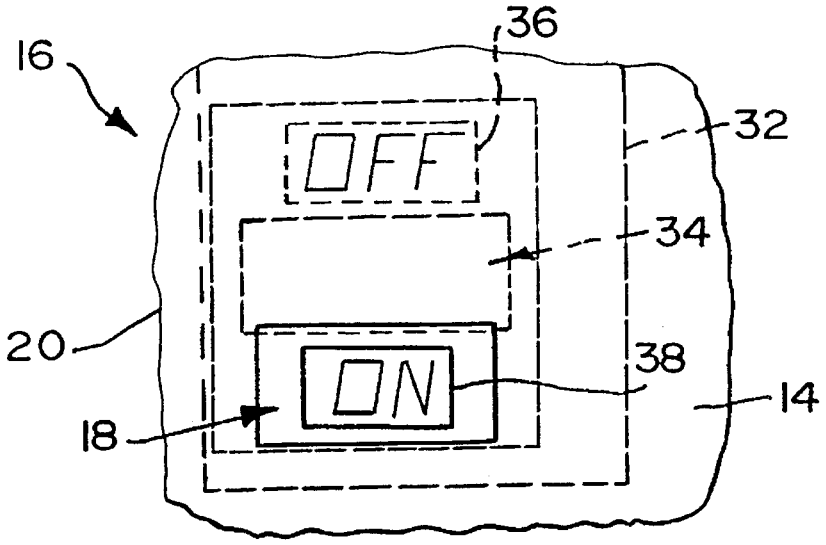
FIG. 6 shows a schematic front view of an indicating means of the circuit breaker of FIGS. 1 to 5.

In use, when the circuit breaker is switched on, the handle 26 is in the position shown in FIG. 1 of the drawings. The cradle 28 is in its untripped position and the inscription "ON" of the label 38 on the slider 32 is visible in the window 18 in the wall 20 of the housing 14, as shown in FIG. 6 of the drawings.

Figure 5:
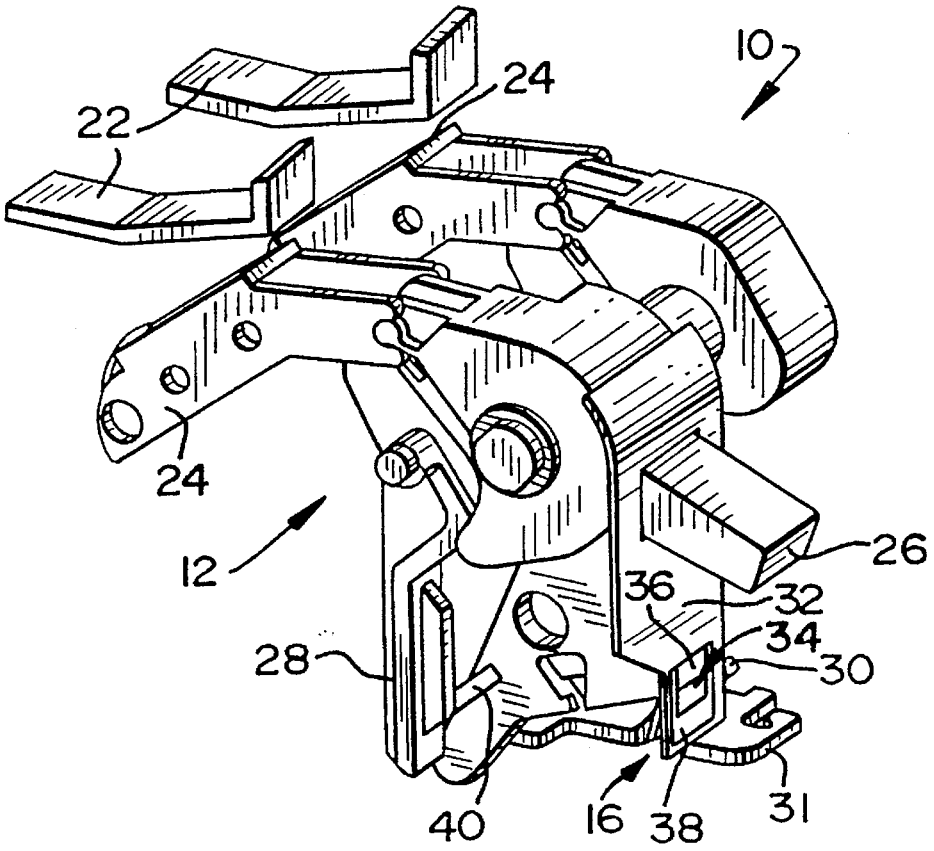
FIG. 5 shows a three dimensional view of part of the circuit breaker with the operating mechanism thereof in its off configuration.

When the circuit breaker 10 is switched off, as shown in FIG. 5 of the drawings, the cradle 28 remains in its untripped position and the inscription "OFF" as carried by the green label 36 on the slider 32 is visible through the window 18 in the wall 20 of the housing 14 of the circuit breaker 10.

Figure 2:
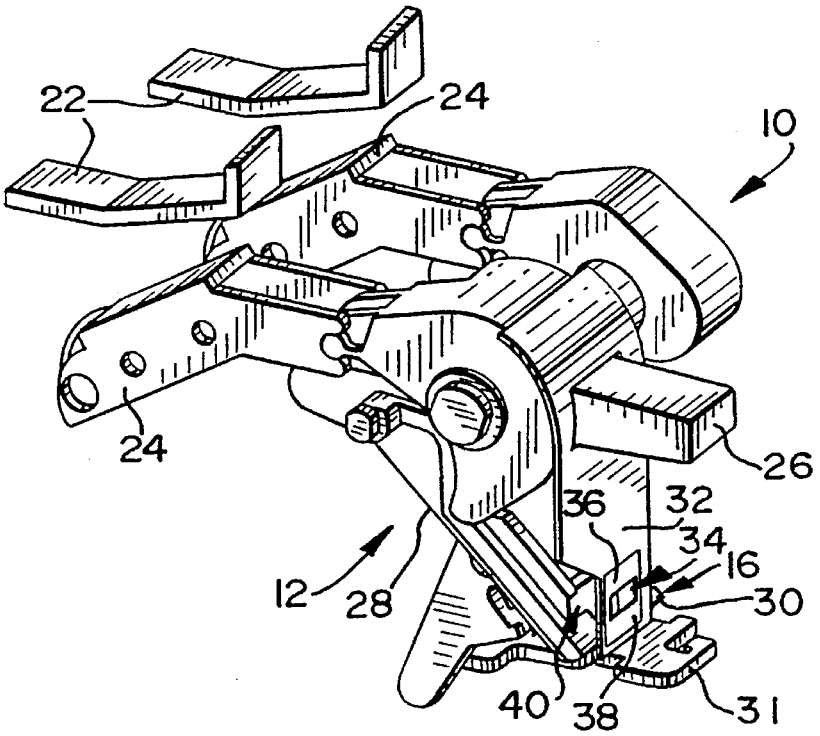
FIG. 2 shows a three dimensional view of part of the circuit breaker with the operating mechanism thereof in a tripped configuration due to an overload fault.

In the event of the circuit breaker tripping as a result of an overload fault, the handle 26 moves to a position between its on position and off position as shown in FIG. 2 of the drawing. When an overload trip condition occurs, the trip mechanism is operated to cause the cradle 28 to rotate from the position shown in FIG. 1 of the drawings to the position shown in FIG. 2 of the drawings. The flag 40, carried on the cradle 28 is then visible through the opening 34 in the slider 32.

When the handle 26 is in its tripped position, the opening 34 in the slider 32 is in register with the window 18 in the wall 20 of the housing 14 such that the flag 40 on the cradle 28 is visible through the opening 32 in the slider 34 and the window 18 of the housing 14. Thus, a viewer can ascertain that the circuit breaker 10 has tripped as a result of an overload fault.

Figure 3:
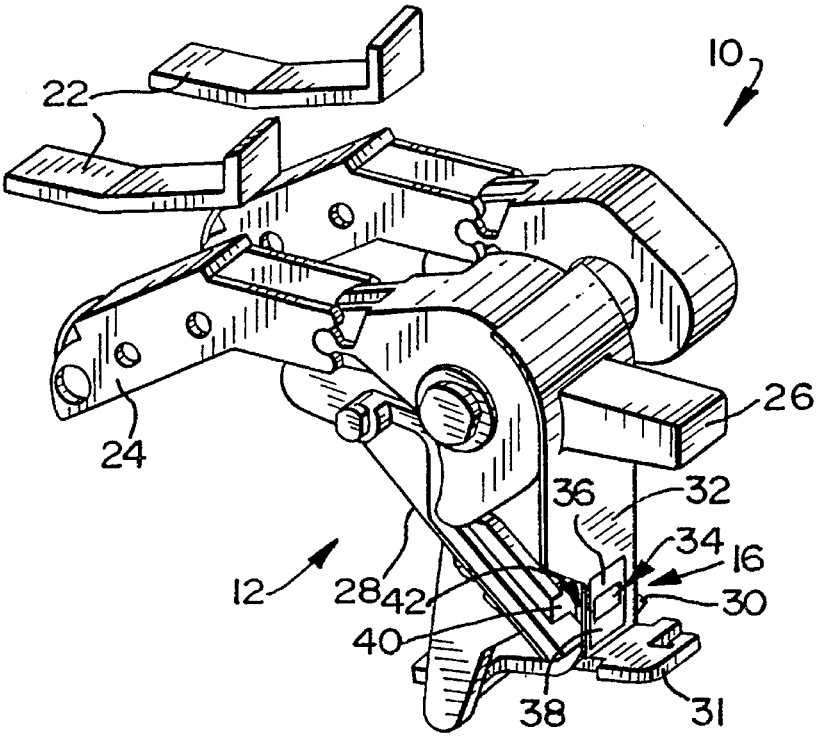
FIG. 3 shows a three dimensional view of part of the circuit breaker with the operating mechanism thereof in a tripped configuration due to an earth leakage fault.
Figure 7:
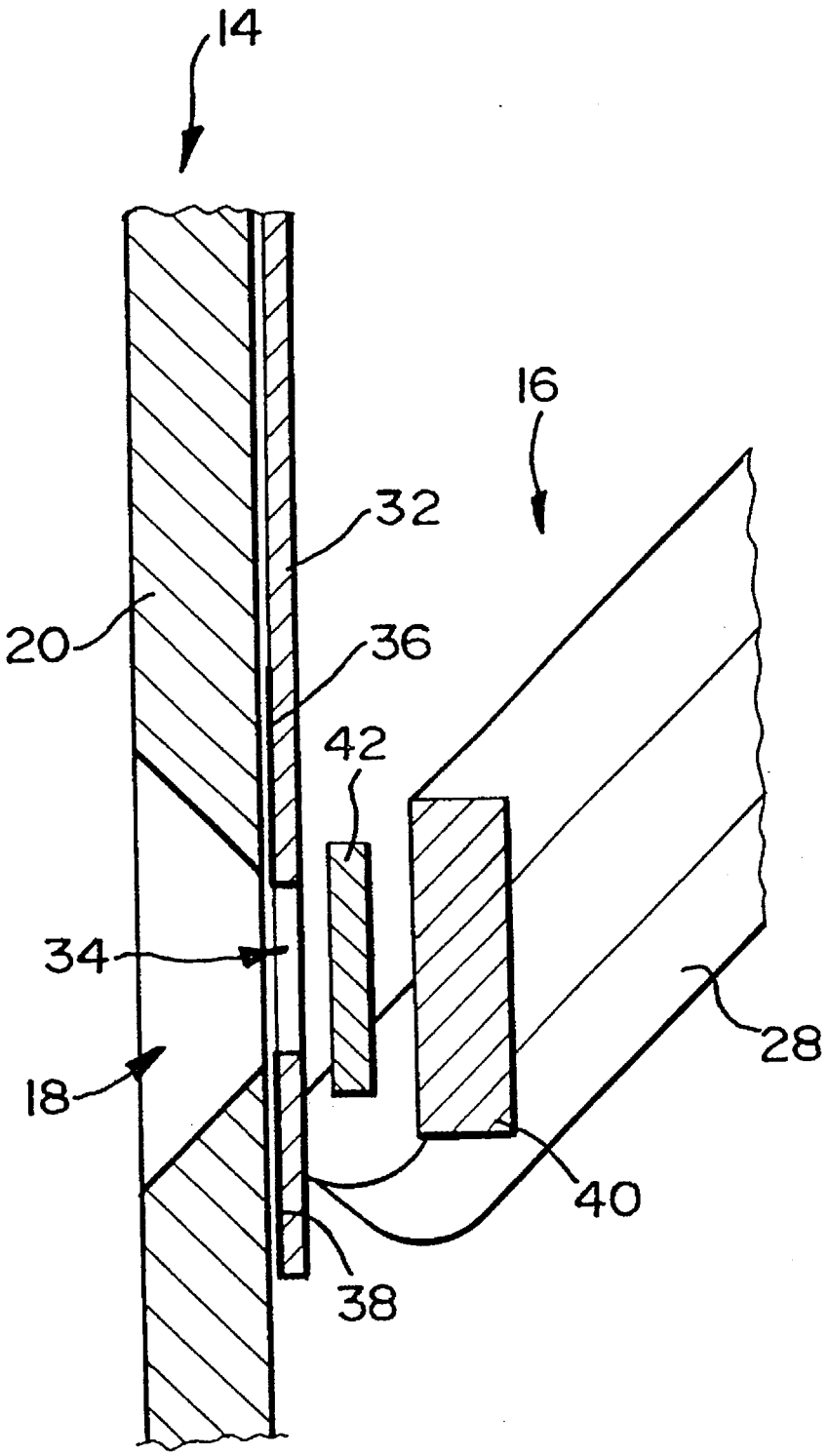
FIG. 7 shows a schematic, sectional side view of the indicating means.

In the event of the circuit breaker 10 tripping as a result of an earth leakage fault, the cradle 28, once again, is rotated to the position shown in FIG. 3 of the drawings. However, the shunt trip armature causes the reset lever 30 to rotate and the flag 42 carried on the reset lever 30 is interposed between the flag 40 of the cradle 28 and the opening 34 in the slider 32. The opening 34 is, once again, in register with the window 18 in the housing 14 such that the flag 42 is visible through the window 18 and the opening 34, as shown in FIG. 7 of the drawings. Thus, a viewer can ascertain that the circuit breaker 10 has tripped as a result of an earth leakage fault.

It will be appreciated that the flags 40 and 42 are distinguishable from each other so that, at a glance, a viewer can ascertain what caused the circuit breaker 10 to trip.

Figure 4:
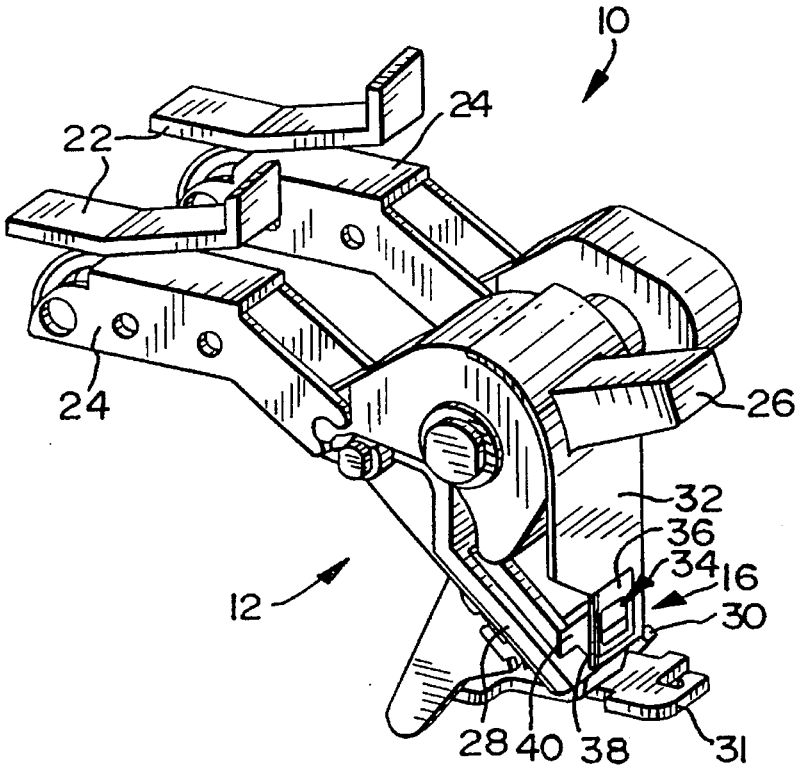
FIG. 4 shows a three dimensional view of part of the circuit breaker with the operating mechanism in a tripped configuration but with contacts of the circuit breaker welded.

In the event that the circuit breaker 10 trips but the contacts 22 and 24 are welded together, the handle 26 is forced to stay in the on position. Then, the "ON" inscription carried by the red label 38 is visible through the window 18 of the housing 14 to indicate that the circuit breaker 10 is still in a dangerous condition. This condition is shown in FIG. 4 of the drawings.

With circuit breakers of which the Applicant is presently aware, if the handle of the circuit breaker has only two positions, then an automatic tripping of the circuit breaker cannot be distinguished from a manual switching-off of the circuit breaker. If the handle of the circuit has a third position, ie. a tripped position, then the cause of the tripping cannot be distinguished.

It is a particular advantage of the invention that, as a result of the indicating means 16, the condition of the circuit breaker 10 can be ascertained at a glance. Further, the cause of a tripping condition can also be ascertained rapidly.

We claim:

1. A circuit breaker which includes:

a housing having a window defined therein;

an operating mechanism contained within the housing, the operating mechanism being operable to trip as a result of an overload fault condition and an earth leakage fault condition; and an indicating means carried by the operating mechanism and being displaceable relative to the housing under the action of the operating mechanism for indicating the status of the operating mechanism, the indicating means including a first indicating element and a second indicating element associated with the operating mechanism, the first indicating element being visible through the window when the operating mechanism has tripped due to an overload fault condition and the second indicating element being visible through the window when the operating mechanism has tripped due to an earth leakage fault.

2. The circuit breaker as claimed in claim 1 in which the operating mechanism further includes a handle, the handle being displaceable between an "on" position, an "off" position and a tripped position and in which a first part of the indicating means comprises a slider mounted on the handle to be displaceable therewith and relative to the window of the housing.

3. The circuit breaker as claimed in claim 2 in which the slider carries indicia thereon for indicating whether the operating mechanism is in its on condition or off condition, the appropriate indicia being visible through the window of the housing depending on the condition of the operating mechanism.

4. The circuit breaker as claimed in claim 1 in which the first indicating element is a first flag carried on a cradle of the operating mechanism.

5. The circuit breaker as claimed in claim 1 in which the second indicating element is a second flag carried by a reset lever of the operating mechanism.

6. The circuit breaker as claimed in claim 5 in which the first flag is distinguishable from the second flag.

7. The circuit breaker as claimed in claim 5 in which the slider has an opening defined therein, which when the handle of the operating mechanism is in its tripped position, lies in register with the window of the housing.

8. The circuit breaker as claimed in claim 7 in which an appropriate one of the flags is visible through the opening and the window when the operating mechanism is in its tripped condition.

* * * * *